United States Patent [19]

Jacobs et al.

[11] 4,260,929

[45] Apr. 7, 1981

[54] HIGH-PRESSURE SODIUM VAPOR DISCHARGE LAMP

[75] Inventors: Cornelis A. J. Jacobs; Marinus F. Brugmans, both of Eindhoven, Netherlands

[73] Assignee: U.S. Philips Corporation, New York, N.Y.

[21] Appl. No.: 55,663

[22] Filed: Jul. 9, 1979

Related U.S. Application Data

[63] Continuation of Ser. No. 894,034, Apr. 6, 1978, abandoned.

[30] Foreign Application Priority Data

Apr. 15, 1977 [NL] Netherlands ..... 7704131

[51] Int. Cl.[3] ..... H01J 61/16; H01J 61/20; H01J 61/22

[52] U.S. Cl. ..... 313/184; 313/201; 313/225; 313/229

[58] Field of Search ..... 313/184, 201, 225, 229

[56] References Cited

U.S. PATENT DOCUMENTS

| | | | |
|---|---|---|---|
| 3,248,590 | 4/1966 | Schmidt | 313/184 |
| 3,384,798 | 5/1968 | Schmidt | 313/225 X |
| 4,037,129 | 7/1977 | Zack et al. | 313/201 |

OTHER PUBLICATIONS

"The High Pressure Lamp", by J. J. deGroot et al., Philips Tech. Review, vol. 35, No. 11-12, pp. 334-342, 1975.

*Primary Examiner*—Palmer C. Demeo
*Attorney, Agent, or Firm*—Robert S. Smith

[57] ABSTRACT

The invention relates to a high-pressure sodium vapor discharge lamp provided with a discharge tube containing mercury and xenon as well as sodium. The sodium vapor pressure—in the operating condition of the lamp—is within a given range.

In accordance with the invention a xenon filling pressure is used which is between 50 and 1000 torr. As a result a lamp can be obtained which has a high luminous efficacy in the operating condition.

4 Claims, 2 Drawing Figures

HIGH-PRESSURE SODIUM VAPOR DISCHARGE LAMP

This is a continuation of application Ser. No. 894,034, filed Apr. 6, 1978, and now abandoned.

The invention relates to a high-pressure sodium vapor discharge lamp provided with a discharge tube which, besides sodium, also contains mercury and xenon, the sodium vapor pressure in the operating condition of the lamp being between 50 and 200 Torr.

A prior art high-pressure sodium vapor discharge lamp of the type defined above is, for example, disclosed in U.S. Pat. No. 3,519,406.

In that known lamp the xenon functions as a starting gas and the mercury as a buffer gas. It should be noted that a starting gas reduces the required starting voltage of a discharge lamp and that a buffer gas limits the heat conduction loss. A disadvantage of the known lamp is that the luminous efficacy, for example expressed in Lumens per Watt, is relatively low.

It is an object of the invention to provide a high-pressure sodium vapor discharge lamp of the type defined above in which the luminous efficacy is high. A further object of the invention is to realize that high luminous efficacy with a lamp having a relative low electric power. Another object of the invention is to combine the high luminous efficacy with a relative low ignition voltage of the lamp.

A high-pressure sodium vapor discharge lamp according to a first part of the invention provided with a discharge tube which, besides sodium, also contains mercury and xenon, the sodium vapor pressure being between 50 and 200 Torr in the operating condition of the lamp, is characterized in that in the operating condition of the lamp the sodium vapor pressure exceeds 100 torr, and that the xenon pressure at 300 degrees Kelvin is between 50 and 1000 torr.

The xenon pressure in the operating condition of the lamp is of course also determined by the average temperature $T_b$ in degrees Kelvin of the discharge tube of that lamp in the operating condition. If therefore the (cold) filling pressure, at 300° Kelvin, of the xenon in the discharge tube is, for example x torr, the pressure of this xenon is approximately $x.T_b/300$ torr in the operating condition. So with a frequently occurring $T_b$ of approximately 2400° Kelvin the xenon pressure in the operating condition of the lamp is between approximately 400 and 8000 torr.

An advantage of a high-pressure sodium vapor discharge lamp according to the invention is that the luminous efficacy thereof can be high. This is inter alia attributable to the fact that also the xenon in this lamp functions as buffer gas.

The following should be noted by way of explanation. One condition required for realising an efficient light production is that in the operating condition of the lamp the sodium vapour pressure is between 50 and 200 torr. Thereby a sodium vapor pressure in the upper part, namely in the part between 100 and 200 torr, of that sodium vapor pressure-range should be realised in the case of a relative low electric power—lower than 400 Watt—of the lamp.

Further it appears that the xenon pressure—in the operating condition of the lamp—must be at least 400 torr to be able to really realise that efficient production of light. With a xenon pressure—in the operating condition of the lamp—which exceeds 8000 torr no further increase in the luminous efficacy has been observed. In the range over 8000 torr the required starting voltage of the lamp rises, however, to unacceptably high values.

It should be noted that a high-pressure sodium vapor discharge lamp provided with a discharge tube which contains xenon as well as sodium, in which the xenon may have a cold filling pressure up to 300 torr, is known per se from U.S. Pat. No. 3,248,590, which is referred to in the above-mentioned U.S. Pat. No. 3,519,406. However, in the discharge tube of that known discharge lamp there is—for the case of the xenon pressure mentioned in the above sentence—no mercury. This has the drawback that the color of the radiated light may contain an excess of green.

Further it should be noted that a high-pressure sodium vapor discharge lamp provided with a discharge tube which contains mercury as well as xenon, in which the xenon pressure exceeds 150 torr, is described in the Japanese Patent application No. 45188/1975. However, a range concerning the sodium vapor pressure, in the operating condition of the lamp, was not found therein.

In a lamp according to the invention the combination of the sodium and the mercury can be dosed in the discharge tube as an amalgam which is poor in mercury or as an amalgam rich in mercury. It is true that an amalgam which is poor in mercury could also result in a greenish colour of the light emitted by the lamp, but here the influence on the colour is less pronounced—and consequently also less objectionable—than in that above-mentioned prior art lamp in which absolutely no mercury was present in the discharge tube.

With a preferred embodiment of a high-pressure sodium vapor discharge lamp according to the invention the weight ratio of the mercury to the sodium in the discharge tube is between 8 and 1.5.

An advantage of this preferred embodiment is that a colour of the emitted light which is not too greenish can be accompanied by a very high luminous efficacy of the lamp. The fact that the color of the light is not too greenish is a result of the fact that the above-mentioned weight ratio exceeds 1.5. The very high luminous efficacy is linked to the condition that that weight ratio should be below 8.

With a further improvement of said last preferred embodiment the weight ratio of the mercury to the sodium in the discharge tube is approximately three.

An advantage of this improvement is that a lamp can be obtained which gives a very good compromise between the spectral distribution of the emitted light, required for public lighting, on the one hand and a high luminous efficacy on the other hand.

When starting a lamp according to the invention the (cold) xenon gas promotes starting, that is to say it tends to reduce the required starting voltage. However, it does so to a limited extent only owing to the considerable pressure of the xenon gas in the cold state of the discharge tube.

In a high pressure sodium vapour discharge lamp according to a second part of the invention, in which the lamp is provided with a discharge tube which, besides sodium, also contains mercury and xenon, the sodium vapor pressure in the operating condition of the lamp being between 50 and 200 torr, wherein the discharge tube is elongate and provided at each of its two ends with a respective internal main electrode, wherein the xenon pressure at 300 degrees Kelvin is between 50 and 1000 torr, and the discharge tube is provided with an auxiliary electrode which, at least during starting of the lamp, is connected to a circuit which, in use, provides the auxiliary electrode with a voltage which promotes starting.

An advantage of this embodiment is that a rather low required starting voltage between the main electrodes of the lamp can be combined with a high luminous efficacy in the operating condition.

The auxiliary electrode may, for example, be an internal auxiliary electrode.

In an improvement in said last mentioned embodiment of a high-pressure sodium vapor discharge lamp according to the invention the auxiliary electrode is external to, and extends over substantially the full length of, the discharge tube.

An advantage of this improvement is that with such an auxiliary electrode, the required starting voltage between the main electrodes of the discharge tube can be markedly decreased, so that the lamp may start reliably.

An embodiment of the invention will be further explained with reference to a drawing in which.

Figure 1:
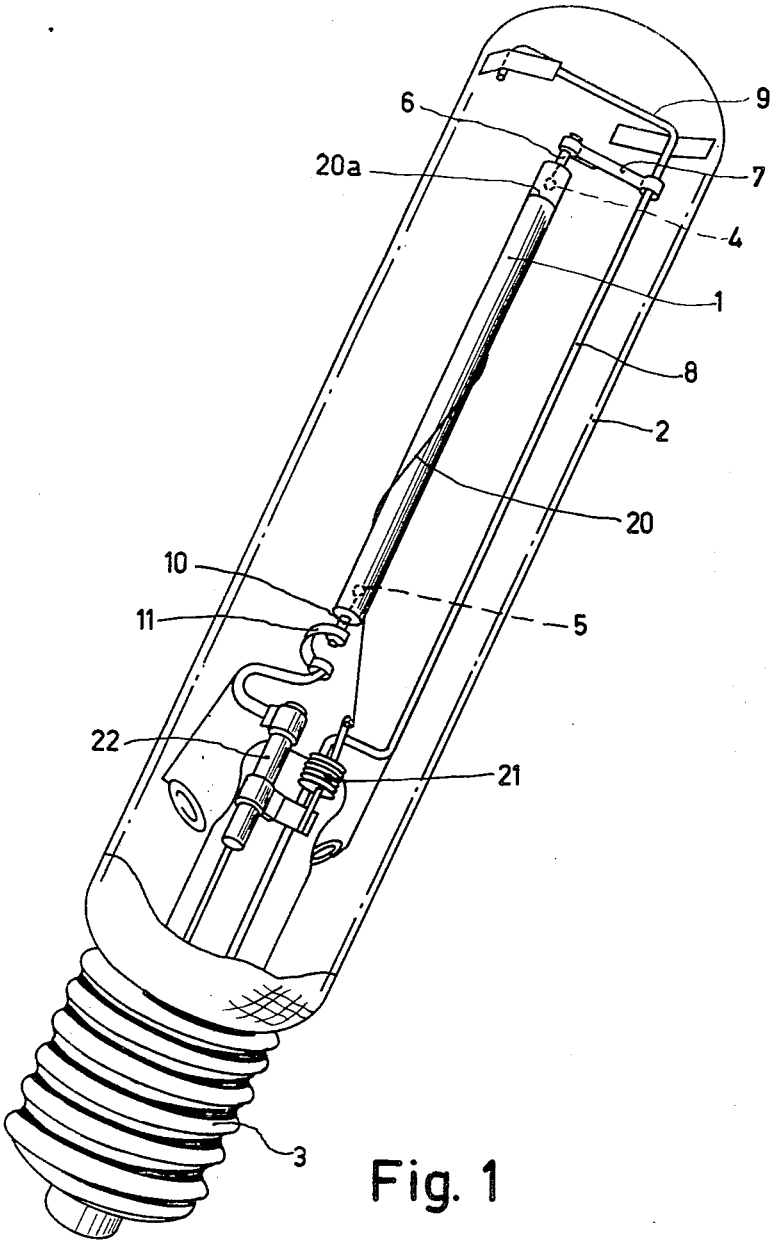
FIG. 1 shows a perspective view of a high pressure sodium vapor discharge lamp according to the invention.

In FIG. 1 reference 1 is a discharge tube whose wall consists of densely sintered aluminium oxide. This tube is disposed in an outer bulb 2. Reference 3 indicates a base of the lamp. The discharge tube 1 is provided with two internal main electrodes 4 and 5 which are disposed near the respective ends of this discharge tube. For further details as regards the arrangements of the electrodes and the feedthrough thereof reference is made to FIG. 2. The main electrode 4 is connected through a feedthrough 6 to a metal strip 7. This strip 7 is connected to a pole wire 8 the major portion of which is parallel to the discharge tube 1. This pole wire is electrically connected to a contact of the base 3 of the lamp. An extended portion 9 of the pole wire 8 is used for supporting and centering the discharge tube 1 in the outer bulb 2. The main electrode 5 is also connected through a tubular feedthrough 10 to a metal conductor strip 11. The other end of this strip 11 is electrically connected to a further contact in the base 3 of the lamp.

In addition, the discharge tube is provided with an external auxiliary electrode 20, which is wound around that tube. This auxiliary electrode 20 is fastened near the main electrode 4 to the discharge tube 1 by means of a loop 20*a*. At the other end of the discharge tube this starting electrode 20 is connected to a tension spring 21. The other end of this spring 21 is electrically connected to a capacitor 22 disposed in the space between the discharge tube 1 and the outer bulb 2. The other end of the capacitor 22 is connected to the metal strip 11 which leads to the main electrode 5 of the discharge tube 1 whereby the auxiliary electrode is provided via capacitor 22 with a voltage which promotes starting.

The spring 21 subjects the auxiliary electrode 20 to a tensile load. Consequently, this auxiliary electrode will always be held in close contact with the outer wall of the discharge tube 1.

The filling of the discharge tube 1 comprises both sodium and mercury as well as xenon. The space between the discharge tube 1 and the outer bulb 2 is evacuated.

The described lamp is, for example, ignited by means of a starter (not shown) provided with a thyristor, for example as disclosed in Dutch Patent Application No. 6,904,456.

In the operating condition of the described lamp it is connected through an inductive stabilization impedance of approximately 0.3 Henry to an a.c. mains supply of approximately 220 Volts, 50 Hz. Further details of the described lamp are included in the following Table (see the right hand column of the Table for that purpose). By way of comparison the centre column of that Table specifies a lamp which has the same external dimensions as the lamp according to the invention but in which the pressure of the xenon gas is much lower than in the case of the lamp according to the invention. In that known lamp the xenon therefore functions as starting gas only whereas in the lamp according to the invention the xenon, together with the mercury, functions as buffer gas. The temperature of the coldest spot in the discharge tube 1 is—in the operating condition of the lamp according to the invention—approximately 1000° Kelvin. A sodium vapor pressure in the discharge tube 1 of approximately 130 torr corresponds therewith. The average temperature of the discharge tube 1 in the operating condition of the lamp is approximately 2400° Kelvin.

TABLE

| | Lamp not according to the invention | Lamp according to the invention |
|---|---|---|
| Power (in watts) | 150 | 150 |
| Operating voltage (in volts) | 100 | 100 |
| Inside diameter of discharge tube (in mm) | 4.8 | 4.5 |
| Main electrode spacing (in mm) | 58 | 63 |
| Weight of the amalgam (mgram) | 25 | 10 |
| $\frac{\text{Weight of mercury}}{\text{weight of sodium}}$ | 4.5 | 2.7 |
| Xenon pressure cold (in torr) | 20 | 200 |
| Xenon pressure during operation (in torr) | 160 | 1600 |
| Laminous efficacy (lumens/watt) | 100 | 115 |
| $R_a$ (color rendering index) | 20 | 19 |

A study of this table shows that the lamp according to the invention has an approximately 15% higher luminous efficacy (in lumens/watt) than the lamp not according to the invention. The colour rendering-index $R_a$ of the two lamps is substantially the same.

Figure 2:
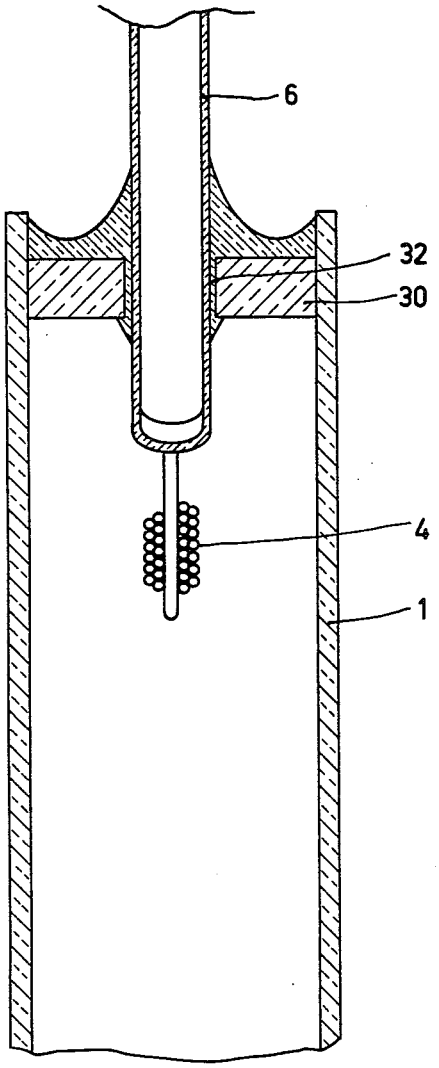
FIG. 2 shows a longitudinal cross-section through an end of a discharge tube of the lamp of FIG. 1.

FIG. 2 shows a longitudinal section through an end of the discharge tube 1 of FIG. 1. Reference 4 indicates the relevant main electrode. Reference 1 represents the wall, of densely sintered aluminium oxide, of the discharge tube. A ring 30, which also consists of densely sintered aluminium oxide, is fastened to the inner wall of the discharge tube 1 by means of sintering. The feedthrough 6, consisting of niobium, is passed through the hole in the ring. The electrode 4 is fastened to this feedthrough 6. The space between the ring 30 and the feedthrough 6 is filled with sealing glass 32 consisting of a mixture of oxides: mainly aluminium oxide, calcium oxide, barium oxide and magnesium oxide. The ring 30 is not at the absolute end of the tube 1 but is displaced approximately 0.5 mm inwards. A part of the remaining space between the ring 30 and the end of the tube 1 is around the feedthrough 6 filled with the same sealing glass as mentioned above.

What is claimed is:

1. A high-pressure sodium vapor discharge lamp provided with a light transparent discharge tube and a pair of electrodes spaced within and sealed to said discharge tube, said tube containing sodium, mercury and xenon, the sodium vapor pressure in the operating condition of the lamp being between 100 and 200 torr, and the xenon pressure at 300 degrees Kelvin being between 50 and 1000 torr, and the weight ratio of the mercury to the sodium in the discharge tube being between 8 and 1.5.

2. A high-pressure sodium vapor discharge lamp as claimed in claim 1, wherein in the discharge tube the weight ratio of the mercury to the sodium is approximately 3.

3. A high-pressure sodium vapor discharge lamp provided with a light transparent discharge tube and a pair of main electrodes spaced within and sealed to said discharge tube, said tube containing sodium, mercury and xenon, the sodium vapor pressure in the operating condition of the lamp being between 50 and 200 torr, said discharge tube being elongated and provided at each of its ends with one of said main electrodes, the pressure of said xenon at 300 degrees Kelvin being between 50 and 1000 torr, the weight ratio of the mercury to the sodium in the discharge tube being between 8 and 1.5, and said lamp further including an auxiliary electrode cooperating with said discharge tube.

4. A high-pressure sodium vapor discharge lamp as claimed in claim 3, wherein said auxiliary electrode is external to, and extends over substantially the full length of said discharge tube.

* * * * *